US005529172A

United States Patent [19]

Laughlin

[11] Patent Number: 5,529,172

[45] Date of Patent: Jun. 25, 1996

[54] COMBINATION GUEST IDENTIFICATION CARD AND ENTRY MEANS HOLDER

[76] Inventor: Luey Laughlin, 314 - B Wisconsin St., Oceanside, Calif. 92054

[21] Appl. No.: 220,739

[22] Filed: Mar. 31, 1994

[51] Int. Cl.[6] ..... A45C 11/32

[52] U.S. Cl. ..... 206/38.1; 206/37.1; 206/477; 206/449; 206/459.5

[58] Field of Search ..... 206/38, 38.1, 477, 206/482, 483, 37, 37.1, 37.3, 37.6, 39, 39.1, 449, 453, 459.5

[56] References Cited

U.S. PATENT DOCUMENTS

| | | | |
|---|---|---|---|
| 556,878 | 3/1896 | Benedict | 206/482 |
| 618,449 | 1/1899 | Warner | 206/482 |
| 2,198,138 | 4/1940 | Sutton | 206/482 |
| 4,331,194 | 5/1982 | Lederer | 206/37.1 X |
| 4,457,425 | 7/1984 | Cooper et al. | 206/38 |
| 4,506,787 | 3/1985 | Bruso | 206/482 X |
| 4,946,030 | 8/1990 | Guridi et al. | 206/38.1 X |
| 5,038,926 | 8/1991 | van der Toorn | 206/38 X |
| 5,183,153 | 2/1993 | Linn | 206/38.1 X |
| 5,184,658 | 2/1993 | Bauman | 206/39 X |

FOREIGN PATENT DOCUMENTS

| | | |
|---|---|---|
| 2249259 | 6/1992 | United Kingdom . |

*Primary Examiner*—Jacob K. Ackun
*Attorney, Agent, or Firm*—Gilliam, Duncan, and Harms

[57] ABSTRACT

An entry means holder for use in combination with an entry means which affords hotels, motels, and other distributors of such entry means a manner of distributing keys and other lock entry means to clients with the security of an anonymous unmarked key or entry means coupled with intitia identifying the customer identification and/or location of the room the means unlocks.

6 Claims, 1 Drawing Sheet

COMBINATION GUEST IDENTIFICATION CARD AND ENTRY MEANS HOLDER

FIELD OF THE INVENTION

This invention relates to entry means devices distributed by businesses to customers seeking entry to locked space to use and/or occupy. More particularly it relates to the distribution by hotels and motels, to cliental of those establishments, of keys and or other electronic and mechanical entry means devices which are left unmarked as to the room or receptacle for such entry means device for security reasons.

PRIOR ART

Hotels, motels and other lodging establishments in the United States and throughout the world have become ever more security conscious in this day and age. One aspect of supplying clients of these establishments added security during their stay is the distribution of unmarked keys and or other mechanical and electronic entry means devices to unlock the doors of guests' rooms during their stay. Supplying these guests with unmarked keys and other entry means, insures that if those unlocking devices are lost or fall into hands of criminal or other dishonest elements, the identity of the room the device unlocks remains anonymous. Without knowledge of the rooms whereabouts, the entry means unlocks, it is useless to the finder.

Electronically coded keys such a plastic cards with magnetic strips and devices with programable microchips on them have the additional advantage of being encoded with a new opening combination with each new guest. Further, if the key to a room is lost, it is easy to recode the lock and any electronic key to open that room thus avoiding the laborious and expensive task of cutting new keys and rekeying doors as when mechanical type keys were lost in the past.

However, interchangibility of blank and or programable keys with all the rooms at an establishment presents another problem besides identification of the room to unauthorized individuals. The individual unlocking devices cannot be marked with a room number since economy dictates that all of the devices can be encoded to fit all of the rooms. Marking electronic and mechanical type entry means devices with individual corresponding rooms would reduce efficiency, and require sorting of returned keys on a daily basis. Such sorting, cataloging, and storing of keys requires many manhours at great cost to the hotel. Efficiency and security concerns thus dictates, that the keys be unmarked and recoded on the arrival of each guest.

The guest however suffers a disadvantage for this increase in hotel efficiency and guest security. With hotels and motels having multiple floors of strikingly similar doors to open, if the guest forgets the room number he or she must return to the front desk to ask what the number is.

This can be embarrassing as well as inconvenient. Many a guest upon arrival is given an unmarked key and upon heading for the elevator or towards the rooms of the hotel forgets the recent encounter with the desk clerk and the room number assigned. Further, many a guest has returned to the hotel late and possibly in a tired or otherwise impaired mental state, and found that the room number defies memory.

Again, such a lapse would require an embarrassing visit to the desk clerk and production of identification to obtain the room number, or, in the event the desk is closed at a late hour, extreme inconvenience would result.

For the hotel the lack of a room number on a key or electronic entry means produces another vexing problem. Such establishments normally have in house restaurants, shops, and other retail establishments the use of which by the guests increases the profits of the establishments. It is imperative therefor that guests with charging privileges be afforded an easy manner to identify themselves as so privileged and thus make a purchase.

The move to unmarked and other electronic entry means in the last decade thus has required that guests carry identification cards to show they are in fact residents of the establishment and have charging privileges. Such identification cards, without a key, mechanical entry means, or electronically encoded door card attached are easily forged. Thus, many hotels not only require the guest to show the identification card, but the entry means also. If the guest does not have both in possession, a sale is lost and both the guest and establishment suffer.

SUMMARY OF THE INVENTION

In summary, the present invention provides an entry means holder for use in combination with an entry means which affords hotels, motels, a manner of distributing keys and other lock entry means to clients with security of an anonymous unmarked key or entry means coupled with initial and continuing identification to the customer of their room.

The present invention affords hotels, motels, and other establishment housing paying guests, the ability to insert the room entry means in a holder which both identifies the room to the guest, and the guest to the hotel. At the same time, it retains the key visibly in the holder for times when possession of both the key and identification is required, such as purchases at the establishment shops, or for the guest in case of memory lapse upon return to the hotel.

Further, it allows the hotel or motel to prepackage and pre encode the entry means with a room number for arriving guests. In hotels with hundreds or even thousands of rooms, a fast check in is imperative and the time it takes to encode entry devices on arrival multiplied by thousands of such arrivals can account for long delays to patrons and excess man hour costs to the hotel. Such prepackaging speeds up the check in process as the room number may be premarked on the identification card, the entry means encoded and attached to the card prior to arrival of the guest. If the invention is manufactured for use on a computer printer, the hotel could pre encode the unmarked entry means to open the room, place indicia regarding the room identification and/or the guest name on the identification card, and combine both the card and the entry means prior to arrival of the guest.

Upon arrival, the guest may De immediately handed the entry means already in the marked holder and sent on his way to the room in short order. Indica on the entry means would of course indicate the room or door number which the entry means unlocks.

Finally, if a second guest identification is required for a roommate of the guest, an embodiment of the invention with a perforation allows for a detachable second identification. The detachable portion of the identification would also allow for meal coupons or advertisements or discount coupons to be preattached to encoded keys prior to or after the arrival of a guest and insure that such identification or valuable coupons only are received by paying guests getting keys or entry means to the hotel.

It is an object of this invention to provide an improved entry means holder for hotels, motels, and establishments which entrust keys and entry means to cliental.

It is a further object of this invention to provide cliental of hotels, motels, and other establishments with easy initial identification of their room while preserving the anonymous aspect of the unmarked entry means in case such entry means falls into the hands of unauthorized persons.

It is a further object of this invention to provide the establishment distributing entry means in this invention the ability to impart a customer identification in combination with a visible entry means which will identify that party to employees of the establishment as a guest and or a guest with charging privileges.

It is a further object of this invention to provide the ability for the hotel, motel or other invention distributing establishment the ability to attache second identifications removable coupons for use by the customer to the enter means holder.

It is a further object of this invention to allow hotels to pre encode programable entry means devices and attach them to a guest identification card which both identifies the guest to the hotel and the room to the guest thus speeding up the check in process.

It is a further object of this invention to protect the magnetic strip on a plastic entry means which is encoded on such a strip form damage while it is being stored by the issuer or carried by the user.

It is a further object of this invention to afford protection to other electronic and mechanical entry means devices from damage during storage or while being carried by the guest.

These and other objects and advantages of the present invention will become apparent to those skilled in the art after considering the following detailed specification in which the preferred embodiment are described in conjunction with the accompanying drawing Figures.

BRIEF DESCRIPTION OF DRAWING FIGURES

DETAILED DESCRIPTION OF THE PREFERRED EMBODIMENT OF THE INVENTION

Figure 1:
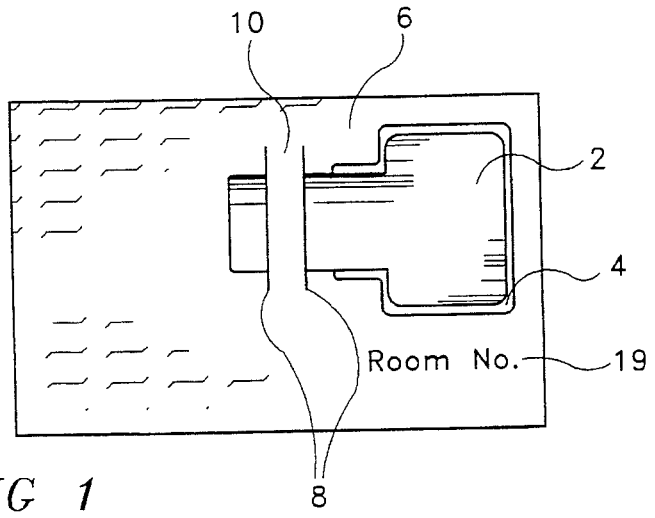
FIG. 1 depicts a top view of the combination guest Identification card entry means holder showing the entry means in a retained position.

Referring now to the drawing FIG. 1, the entry means holder 6 contains an encompassing aperture 4 which is cut into the entry means holder 6 using a die or other device. The encompassing aperture 4 could also be formed by molding it or cutting it into plastic version of the entry means holder 6, or by cutting it into a paper version of the entry means holder 6.

The material for the entry means holder 6 can be paper card stock, plastic, film, or any other material with a flexibly rigid construction. That is to say the material should be flat and return to its flat shape if slightly bent by the user. In this manner, if the encompassing aperture 4 is cut to a size substantially equal or slightly larger then a first end of the entry means 2 which the encompassing aperture 4 surrounds, when the second end of the entry means 2 is inserted thorough a plurality of retainment openings 8, the first end of the entry means 2 will cause that end to stay positioned inside the encompassing aperture 4. Many entry means in use today have one end shaped similar to the handle end of an old style key and have a thickness significantly thicker than the second blade end of such an entry means. With the encompassing aperture 4 surrounding the thickened handled end of the entry means in a close proximity to its perimeter, when the semi rigid card stock, returns to a flat position, the thicker handle end of the entry means 2 tends to stay inside the encompassing aperture 4. With second blade end of the entry means 2 is held in place by being inserted through a plurality of retainment openings 8 forming an entry means retainer strip or strips 10 which encompass the entry means 2 between the aperture that is formed between the flat entry means holder 6 and the entry means retainer strip 10 both ends of the key shaped entry means 2 remain secure in the entry means holder. In fact, if held in a position perpendicular to the check in courter, the outside perimeter of the handle end of the key shaped entry means 2 is supported by the inside edge of the encompassing aperture 4 is such a vertical position. Indicia, 19 is placed upon the entry means holder 6 to identify the location for use of the accompanying entry means 2.

Figure 2:
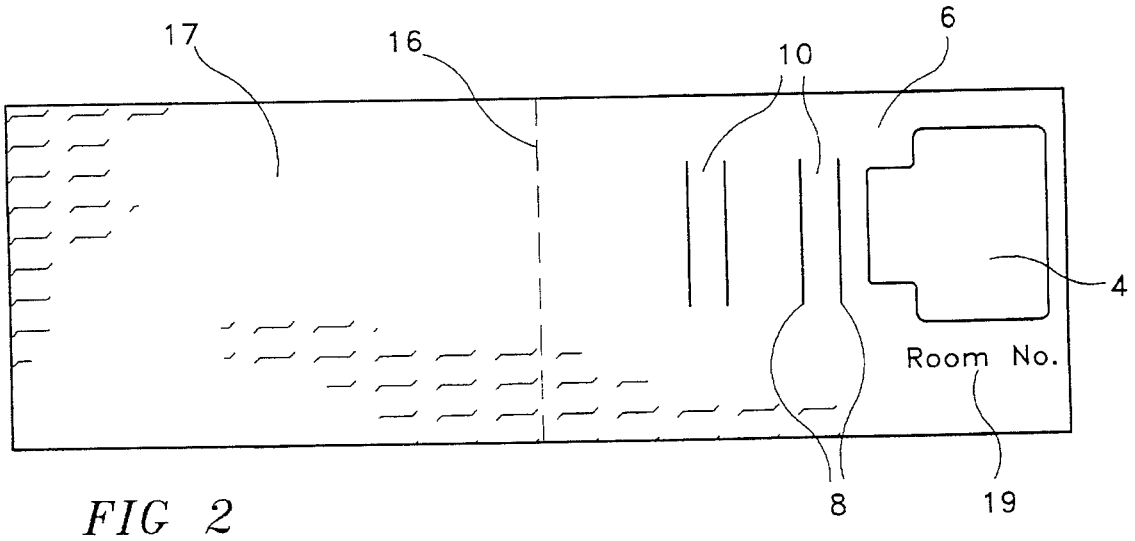
FIG. 2 depicts a top view of the combination guest identification card and entry means holder without the enter means retained in the entry means holder.

A second embodiment of the invention shown in FIG. 2 operates in much the same manner as the embodiment in figure one. In this embodiment a frangible portion 16 in the entry means holder 6 allows for detachment of part of the entry means holder 6 thus allowing for distribution to the guest of a second identification card or coupon 17 upon detachment the indicia 19 thereon identifying the guest and/or location of the lock opened by the entry means 6.

Figure 3:
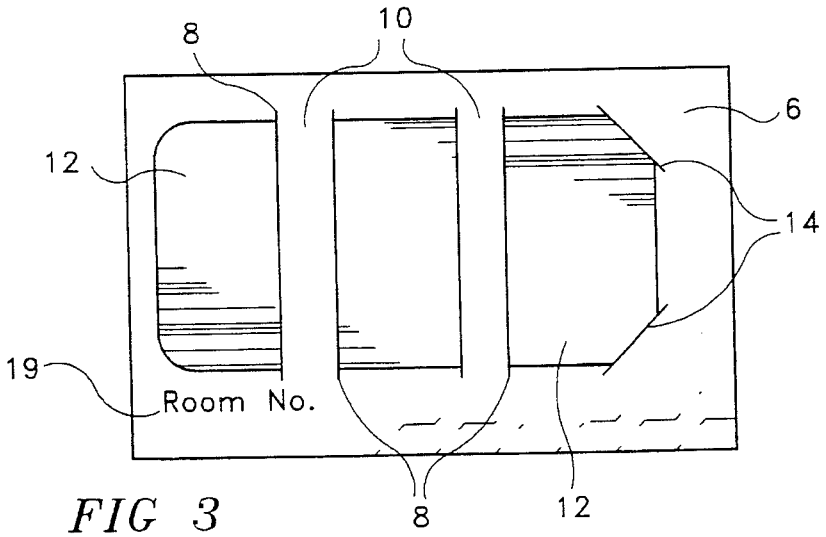
FIG. 3 depicts a top view of another embodiment of the combination guest identification card and entry means holder.

A third embodiment of the invention shown in FIG. 3 shows a card shaped entry means 12 with a first end inserted through a plurality of retainment openings 8 and a second end of the rectangular shaped entry means 12 having its two corners inserted into two correspondingly positioned diagonal retainment openings 14. This second end of the card shaped entry means 12 remains removably in place in the entry means holder 6 with each the two corners of the first end encompassed inside a corresponding aperture formed by the two corresponding diagonal retainment openings 14.

The insertion of the first end of the card shaped entry means 12 though the plurality of retainment openings 8 causes the first end of card shaped entry means 12 to be enclosed between a entry means retainer strip 10 formed by two of the retainment openings 8 and the entry means holder 6.

The material from which the entry means holder 6 is manufactured must be semi rigid in construction. That is to say the material has memory and returns to essentially its oringial shape subsequent to being distorted. In this manner the material exerts pressure upon the entry means 2 or 12 after the entry means holder 6 is bent to allow for the insertion of one or both ends through the retainment openings 8 or into the diagonal retainment openings 14 at two corners of the entry means 12 and the material returns to its former unbent condition. If desired, a third diagonal retainment opening 14 or a second pair of diagonal retainment openings 14 could be provided opposite to the pair shown in FIG. 3 such that the one or both of the corners on the opposite end of the card shaped entry means 12 could be inserted into the second set of corresponding diagonal retainment openings. Such a configuration would allow for the elimination of the entry means retainer strip 10 while affording a solid mounting for the card shaped entry means 12. However, one or a plurality of the entry means retainment openings 10 formed by each pair of retainment openings 8 could also be left in place allowing for an especially secure temporary mounting of a card shaped entry means 12.

In that the invention will most probably be disposable the material should also be inexpensive and easy to fabricate. Dye cutting of paper stock is one manner to accomplish manufacture of the invention. To date, 110 pound card stock of a thickness of 0.0093 inches has been used with great success. However, paper card from a minimum of 60 pound strength and a thickness of 0.0036 inches to a maximum of 200 pound strength and 0.024 inches thick could be used cost permitting. However in the dye cut process any number of plastic films or other materials which have a semi rigid final composition would suffice.

The material for the invention could also consist of molded plastic with the required openings being provided for in the mold prior to injection.

Although the present invention has been shown and described with references to particular embodiments, nevertheless, various changes and modifications obvious to one skilled in the art to which the invention pertains are deemed within the purview of the invention.

What is claimed is:

1. In combination with a credit card shaped entry means having a first end with two corresponding corners, and having a second end, an entry means holder comprising:

a) a sheet of resilient material of a size sufficient to hold said entry means; and b) a plurality of openings placed in said sheet of resilient material forming at least one retainer strip of sufficient size to accommodate the insertion of said second end of said entry means component therethrough, removably securing said second end upon said entry means holder;

c) a plurality of angled openings placed upon said entry means holder in a position to overlap said two corresponding corners of said first end of said entry means, said angled openings being of sufficient size to allow insertion of said two corresponding corners of said first end of said entry means therein, removably securing said first end of said entry means upon said entry means holder;

d) indicia located upon said entry means holder identifying a specific location for use of said entry means.

2. The invention as recited in claim number 1 wherein said plurality of slits form a plurality of said retainer strips.

3. The invention as recited in claim number 1 wherein said entry means can be electronically encoded to open one of a plurality of locks.

4. The invention as recited in claim 1 wherein said sheet of resilient material is selected from the group consisting of paper, card stock, cardboard, film, plastic, and combinations thereof.

5. The invention as recited in claim 1 wherein a portion of said sheet of resilient material is rendered frangible at a predetermined position to form a detachable guest identification card portion of said entry means holder.

6. The invention as recited in claim 1 wherein the thickness of said resilient material is from about 0.0030 inches to about 0.030 inches.

* * * * *